US005088829A

United States Patent [19]

Dez et al.

[11] Patent Number: 5,088,829

[45] Date of Patent: Feb. 18, 1992

[54] SELF-RETRACTABLE SIGHTING DEVICE FOR ONBOARD OPTOELECTRONIC LOCALIZATION AND IDENTIFICATION SYSTEM

[75] Inventors: Olivier Dez, Issy-les-moulineaux; Vincent Vilbois, Montigny le bretonneux, both of France

[73] Assignee: Thomson-CSF, Puteaux, France

[21] Appl. No.: 636,100

[22] Filed: Dec. 31, 1990

[30] Foreign Application Priority Data

Jan. 16, 1990 [FR] France ..... 90 00427

[51] Int. Cl.[5] ..... B64C 7/00; G02B 7/198; G02B 23/08; G02B 23/16

[52] U.S. Cl. ..... 359/396; 359/404; 359/841; 359/862

[58] Field of Search ..... 350/321, 543, 544, 623, 350/618, 604; 89/36.14, 37.21, 41.06, 41.21

[56] References Cited

U.S. PATENT DOCUMENTS

| | | | |
|---|---|---|---|
| 1,341,683 | 6/1920 | Stull | 350/543 |
| 1,979,011 | 10/1934 | Potez | 89/37.21 |
| 2,105,055 | 1/1938 | Sanders | 89/37.21 |

FOREIGN PATENT DOCUMENTS

| | | | |
|---|---|---|---|
| 1940668 | 9/1977 | Fed. Rep. of Germany | 89/36.08 |
| 2618122 | 1/1989 | France . | |
| 918118 | 2/1963 | United Kingdom . | |

OTHER PUBLICATIONS

Aviation Week & Space Technology, vol. 123, No. 7, pp. 44–47, Aug. 19, 1985, H. J. Coleman, "Two Federal Agencies Support Hypersonic Transport Research".

*Primary Examiner*—Jon W. Henry

*Attorney, Agent, or Firm*—Oblon, Spivak, McClelland, Maier & Neustadt

[57] ABSTRACT

The self-retracting sighting device for an onboard opto-electronic localization and identification system has an elongated shape such that its rotation axis in elevation, beneath the fuselage of the carrier, is off-centered with respect to the input pupil. For the bottom line of sight, the device protrudes out of the fuselage to a major extent but, when the elevation angle increases, the device self-retracts beneath the fuselage, the top lines of sight being obtained without hindrance to the pilot's visibility. By additional rotation about the elevation axis, the input pupil is completely retracted beneath the fuselage, that part of the sighting device that protrudes out of the fuselage being then at its minimum and having an aerodynamic shape. The device can be applied notably to carriers in which the pilot's visibility is essential, for example during the stages of touchdown on aircraft carriers.

8 Claims, 3 Drawing Sheets

FIG_1
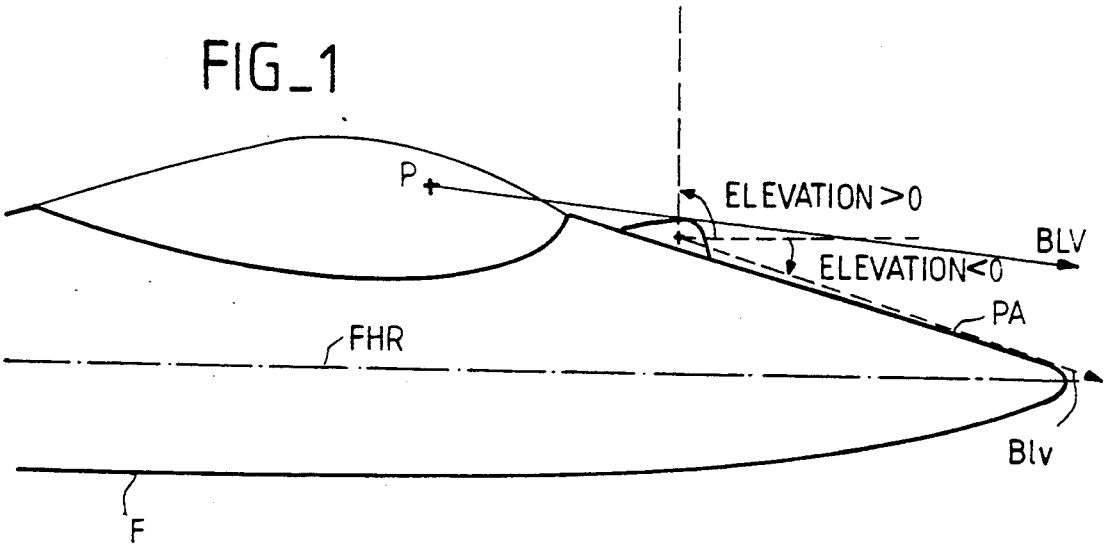
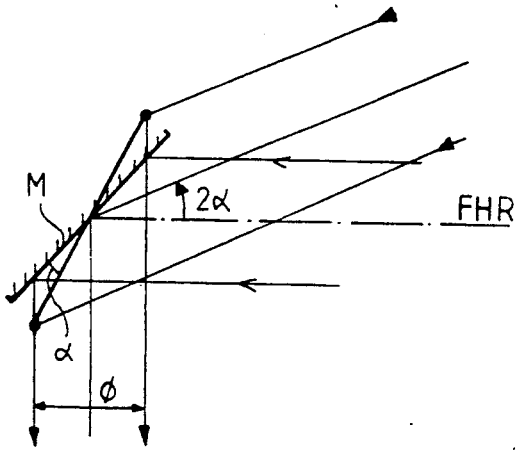
FIG_2
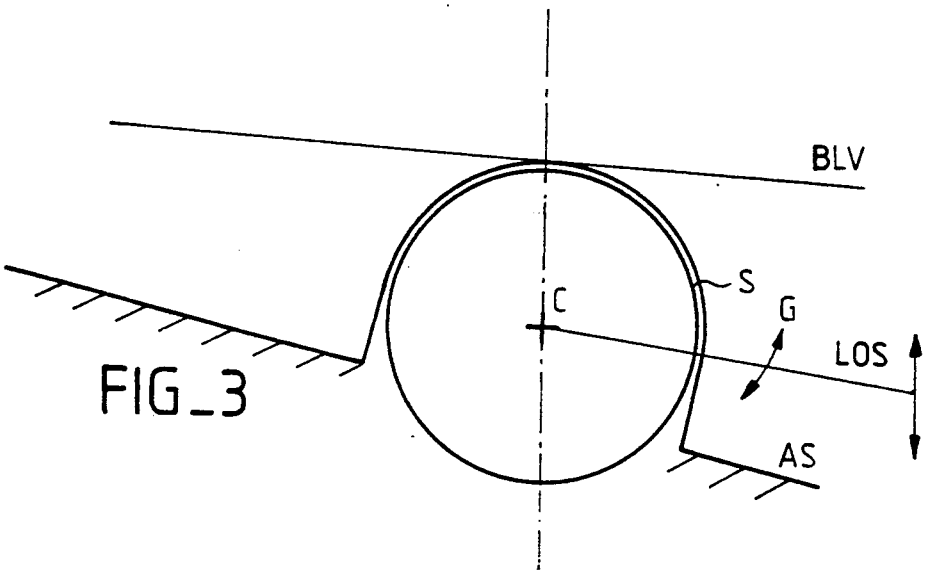
FIG_3

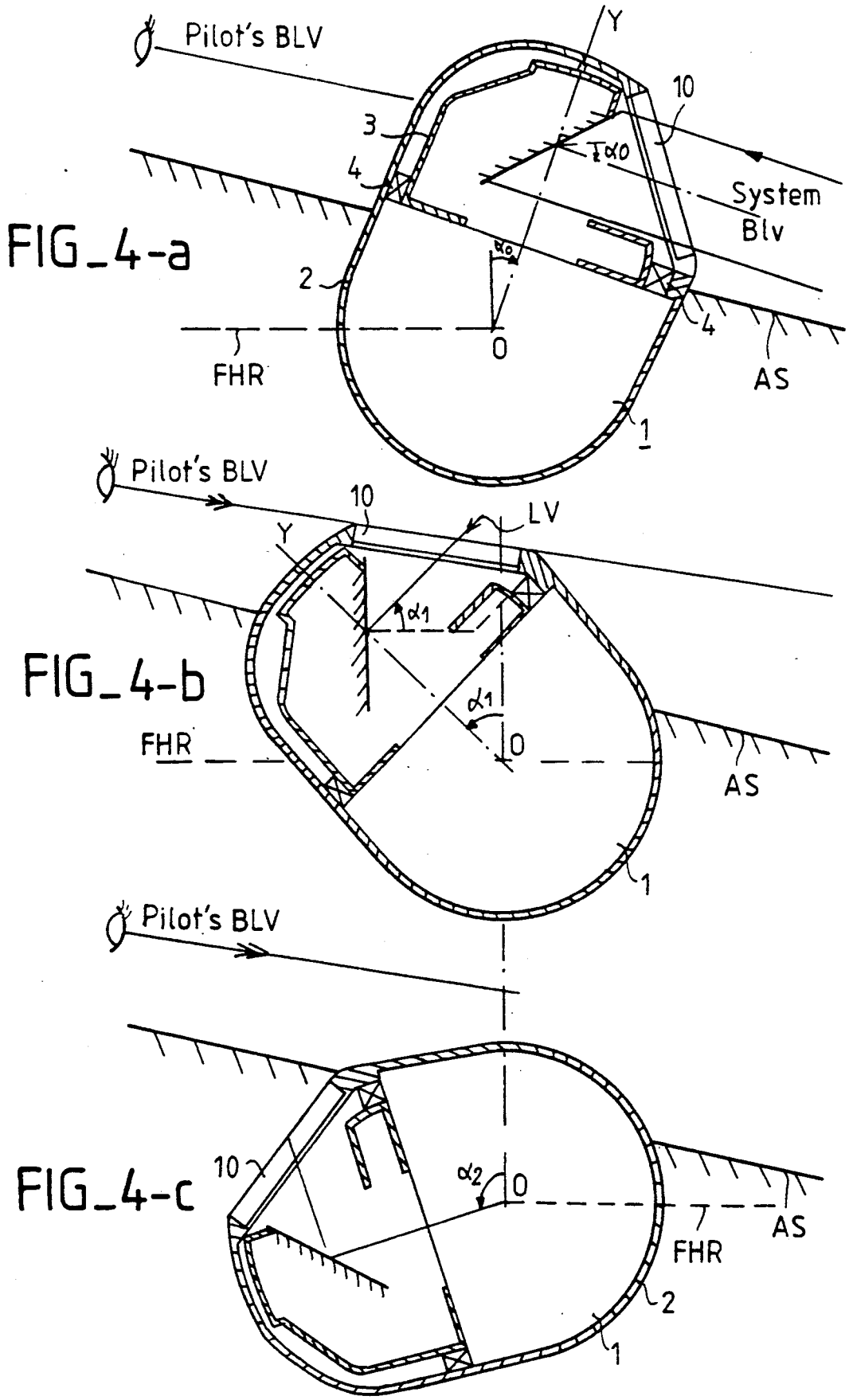
FIG_4-a
FIG_4-b
FIG_4-c

FIG_5-a
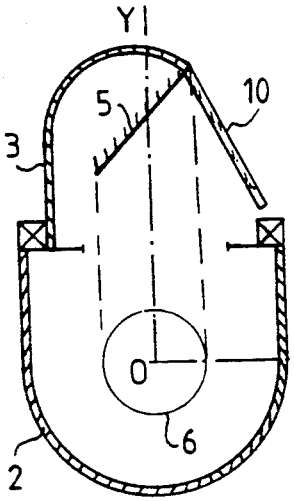
FIG_5-b
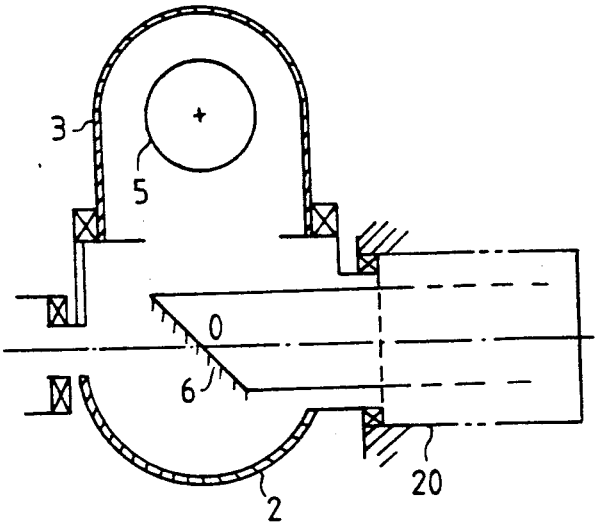
FIG_6-a
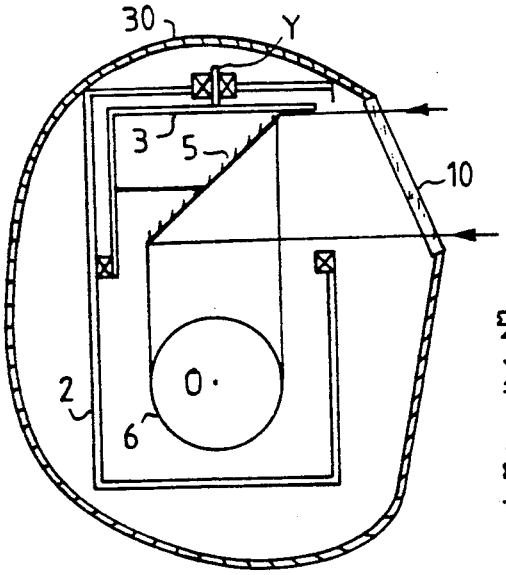
FIG_6-b
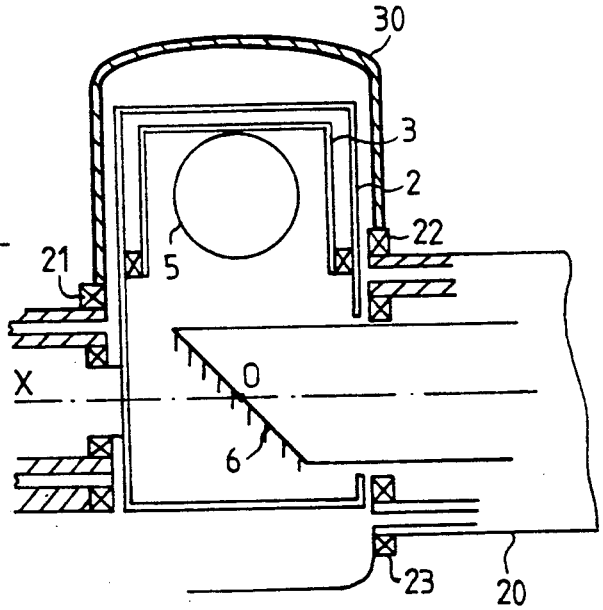

SELF-RETRACTABLE SIGHTING DEVICE FOR ONBOARD OPTOELECTRONIC LOCALIZATION AND IDENTIFICATION SYSTEM

BACKGROUND OF THE INVENTION

1. Field of the Invention

The invention pertains to the field of optoelectronic systems carried on board aircraft, notably designed for the 3D localization and/or identification of targets, for example, and more particularly, to a self-retractable sighting device for a system such as this.

An major parameter in onboard optoelectronic systems for 3D localization and/or identification is the angular deflection of the line of sight. Indeed, it is quite important that this type of onboard equipment should enable localization and identification in the widest possible sectors. The ideal layout would be that in which the optoelectronic equipment is placed directly at the tip of the aircraft nose. This is generally not possible because of the presence of the radar at this position.

2. Description of the Prior Art

Positioning the optoelectronic equipment beneath the aircraft does not enable the line of sight to be oriented towards the elevation angles that are positive with respect to the horizontal fuselage reference of the aircraft.

A lateral positioning would present a big mask, in relative bearing, owing to the presence of the nose, unless two symmetrically positioned systems were used, thus notably increasing the cost.

The so-called "canopy base" layout, just before the windscreen, makes it possible to obtain the biggest acquisition fields and the most valuable ones from the operational point of view.

Now, the layout of an optoelectronic localization and acquisition equipment, notably in a warplane, in a canopy base layout creates a mask that is all the greater as the field of acquisition of the localizing equipment is big. To enable the orientation of the field, namely of the line of sight, downwards along elevation angles that are negative with respect to the horizontal fuselage reference HFR and are possibly big angles, the localizing system enabling the orientation of the line of sight should protrude out of the aircraft skin AS, as can be seen in FIG. 1 which shows an aircraft fuselage F in a partial view with its horizontal reference HFR. The pilot P in his cockpit has his bottom line of visibility BLV in the direction (in relative bearing) of the optoelectronic equipment limited by this system. The bottom line of sight Bls of the optoelectronic equipment is, for its part, limited by the fuselage or "skin" AS of the aircraft.

The main orientation devices of the line of sight mounted on presently existing aircraft do not generally enable a wide angular deflection of the line of sight, or else when the angular deflection is more or less suitable, the device blocks out the pilot's visibility to a major extent. These devices presently exist only on aircraft that are not subjected to the constraints necessitated by landings in extremely restricted zones, for example on aircraft carriers. Therefore, none of the devices existing to date is subjected to the constraints of visibility necessary for touchdown on an aircraft carrier.

SUMMARY OF THE INVENTION

An object of the invention is a device for an onboard optoelectronic localization and identification system, enabling wide angular deflections of the line of sight to be obtained while, at the same time, clearing away obstacles to the pilot's visibility during the stages of take-off, landing and touchdown on aircraft carriers, as well as during the stages in flight when the system is not operational. To this end, the device is self-retractable.

According to the invention, there is provided a self-retractable sighting device for an onboard optoelectronic localizing and identification system including, for the orientation of the line of sight, an elevation structure and a relative bearing structure borne by the elevation structure to which is it is connected by bearings, these two structures being capable of rotating respectively about an elevation axis and a relative bearing axis, wherein the device has an input pupil off-centered with respect to the elevation axis of the device, itself located at a position lower than that of the fuselage of the carrier, the device having an elongated shape with its large dimension close to the vertical with respect to the carrier for the bottom-most line of sight where the elevation angle is negative with respect to the horizontal fuselage reference, and with its large dimension close to the horizontal with respect to the carrier for the top-most line of sight, the sighting device being in a state of maximum protrusion for the bottom line of sight and then self-retracting as and when the elevation angle increases by rotation about the elevation axis.

BRIEF DESCRIPTION OF THE DRAWINGS

The invention will be understood more clearly and other features will emerge from the following description, made with reference to the appended drawings wherein:

FIG. 1 is a general drawing used to show the concealment of the pilot's bottom line of visibility, caused by a front sector optoelectronic acquisition system;

FIGS. 2 and 3 are drawings illustrating devices according to the prior art;

FIGS. 4*a*, 4*b* and 4*c* illustrate the self-retractable device according to the invention, in a sectional view in three different positions;

FIGS. 5*a* and 5*b* illustrate a second embodiment of the self-retractable device according to the invention, having a smaller space factor with a borne port;

FIGS. 6*a* and 6*b* represent a third embodiment of the invention, with follower cap.

DESCRIPTION OF THE PREFERRED EMBODIMENTS

For a clearer understanding of the essential features of the invention, and for a better appreciation of its advantages, a brief description shall be given here below of known line-of-sight orienting devices.

According to a first type of device shown in FIG. 2, the line-of-sight orienting device is located in the plane of symmetry of the aircraft. The principle chosen is that of the use of a Pogendorf mirror M (called a ½ mirror), i.e. the line of sight rotates by $2\alpha$ when a mirror undergoes a rotation of $\alpha$. A device such as this does not allow for orienting the line of sight LOS towards very high elevation angles in relation to the horizontal fuselage reference HFR owing to the principle chosen and the limited dimension of the mirror. Moreover, the pilot's visibility is greatly blocked in the axis since the system is positioned in the plane of symmetry of the aircraft.

In another type of device, the principle used is the same one: a mirror M is rotated by an angle equal to half the angle of sight with respect to the reference HFR, but the line-of-sight orientation device is offset with respect to the axis of symmetry of the aircraft. The same restriction arises for the orientation of the line of sight towards very high elevation angles, and the pilot's downward visibility is still blocked, but it is blocked laterally instead of on the axis as in the previous case.

According to a third type of device shown in FIG. 3, also laterally, the blocking or concealment of the bottom line of sight is of the same order: by contrast, the angular field accessible is greater because the system provides for a coupling of axes enabling the line of sight to be oriented at the same time in elevation and in relative bearing. A device such as this is constituted by a sphere S rotating about a fixed point C which is the center of the sphere and is always in a high position with respect to the fuselage of the aircraft. This sphere always blocks the pilot's visibility in the same way since the sphere rotates about its center which is the intersection of the two axes of rotation. Furthermore, a device such as this has a major drawback as regards a surveillance operation for, while the different elements of the device can easily be positioned to obtain a line of sight in a given direction, it is far more difficult to achieve a servo-control of the entire unit.

According to the invention, firstly the device provides for access to a wide angular field, the bottom elevation angle being far greater than in the standard systems and, secondly, this system is not detrimental to the pilot's visibility during the stages when this visibility is quite essential (for example, at the stages of landing, touchdown on aircraft carriers etc.) for the system is designed to be retractable so as to totally clear away every obstacle to the pilot's visibility when he wishes it or when there is a malfunctioning of the sighting device.

To resolve this problem, one approach could have used a device that is self-retractable (by translation) and has two positions, namely an outgoing position during the periods of orientation of the line of sight, and the position of withdrawal by translation so that it no longer protrudes out of the aircraft skin during the critical stages of touchdown on aircraft carriers, landing etc. In practice, a device such as this would be difficult to implement in view of the structure of the optical devices forming part of the optoelectronic localizing and orientation device and, furthermore, in the withdrawn position, it would occupy a volume taken from the useful volume of the aircraft.

As a consequence, according to the invention the localization device with a wide angular deflection is retractable by rotation about a fixed point 0. To this end, the device has a shape that is particularly well suited, firstly, to the function of localization and, secondly, to retraction. The sighting device 1 according to the invention is shown in FIGS. 4*a*, 4*b* and 4*c*: this sighting device includes a elevation structure 2 which forms the casing of the device and is capable of rotation to define the elevation angle $\alpha$ of the line of sight LOS about a elevation axis orthogonal to the sectional plane of the FIGS. 4*a*, 4*b* and 4*c*, the trace of this elevation axis being 0. A port 10 is provided in the elevation structure. It is a flat port or, preferably, a spherical or facetted port to enable the wide deflections desired in the line of sight. In any case, the port 10 has its dimensions matched with the desired relative bearing field. The device further includes a relative bearing structure 3 capable of rotating within the elevation structure 2 to define the relative bearing angle $\theta$ of the line of sight about a relative bearing axis OY that is orthogonal to the elevation angle and, hence, in the plane of the FIGS. 4*a*, 4*b*, 4*c*. To this end, two roller bearings 4 enable the rotation of the relative bearing structure with respect to the elevation structure. With each of these structures, there is associated an onward-reflection mirror, respectively 5 and 6, for onward reflection towards an optical device, generally with a long focal distance, not shown in FIGS. 4*a*, 4*b* and 4*c* but shown in FIG. 5*b* described hereinafter, an optical sensor being associated with this optical device.

In FIGS. 4*a*, 4*b* and 4*c*, the port 10 of the optoelectronic localization device is respectively:

in the position associated with the bottom-most line of sight Bls of the optoelectronic equipment in FIG. 4*a*, where the elevation angle is negative;

in a position associated with an angle of sight corresponding to a elevation angle that is positive with respect to the horizontal fuselage reference in FIG. 4*b*;

and in a retracted position where the protruding of the system out of the fuselage is minimal, the fuselage then offering little resistance to air (i.e. having good aerodynamic qualities).

As in FIG. 1, AS designates the "skin" of the aircraft (fuselage) and BLV is the pilot's bottom line of visibility. As these figures show, the system has an input pupil 10, off-centered with respect to the elevation axis. In FIG. 4*a*, the low elevation angle $\alpha_0$ capable of being sighted, corresponding to the bottom line of sight, is of the order of $-20°$ with respect to the horizontal fuselage reference HFR. By contrast, as shown in the figure, the pilot's visibility is masked in a part of the field by the sighting device.

The sighting device according to the invention is, for this reason, positioned in a canopy base layout but is preferably outside the axis of symmetry of the aircraft so that the pilot's downward visibility is not masked in the central part of the field. From this bottom position onwards, a rotation about the elevation axis enables the elevation angle to be made to vary without, however, even further hindering the pilot's visibility. To this end, the elevation angle of off-centered with respect to the port in such a way that this rotation causes, at the same time, a retraction of a part of the sighting device beneath the aircraft skin AS.

Starting from the particular position shown in FIG. 4*b*, where the elevation angle $\alpha_1$ is positive and of the order of $+45°$, the pilot's downward visibility is no longer masked even by the sighting device 1. Beyond this, by an additional rotation of the sighting device 1 about 0, the elevation angle is further increased up to a value of the order of 90°. Finally, as shown in FIG. 4*c*, an additional rotation up to $\alpha_2$ enables an even more appreciable retraction of the sighting device 1 under the aircraft skin: the part of the sighting device that emerges out of the aircraft skin no longer contributes anything other than a very small aerodynamic disturbance, this result being achieved without any substantial increase in the volume necessary within the aircraft. In this last zone of rotation, the sighting device is no longer operational once the port starts disappearing under the aircraft skin.

The shape of the sighting device is important.

For, in the retracted mode, it is useful for the shape to be as aerodynamical as possible. For this reason, the bottom part of the sighting device in the operational position (which is also the top part of the sighting device in the retracted position) is hemispherical in the embodiment shown in FIGS. 4*a*, 4*b* and 4*c*. Then, the structure is cylindrical on a part of its height. Finally, the top part in the operational position is constituted by a spherical part and by the part occupied by the port 10, which may be plane, spherical or facetted as indicated above.

Naturally, the invention is not restricted to the embodiment described and shown. In particular, modifications are possible in the external shape of the sighting device, provided that the essential characteristics are truly respected, i.e. provided that, to obtain a line of sight as downward as possible in elevation, the sighting device goes sufficiently beyond the aircraft skin when the sighting device is in this operational position and provided that, conversely, to ensure that the pilot has maximum visibility in certain delicate stages, where the sighting device does not have to be operational, the sighting device is as retracted as possible beneath the aircraft skin, in achieving this by rotation about a center of rotation merged with the intersection 0 of the elevation and relative bearing axes.

Other embodiments are possible. It is possible to have the port carried by the relative bearing structure 3 rather than by the elevation structure 2 of the sighting device in order to minimize the dimensions of this elevation structure 2 which, in the drawings of FIGS. 4*a*, 4*b*, 4*c*, encases the relative bearing structure 3. The resultant structure is shown schematically in FIGS. 5*a* and 5*b* where the same references are repeated for the same elements as in the foregoing figures. FIG. 5*c* shows this sighting device along the same sectional plane as in FIGS. 4*a*, 4*b* and 4*c* while FIG. 5*b* shows the device in a section orthogonal to the former one containing the elevation axis OX. In this FIG. 5*b*, the port 10 in front of the figure can no longer be seen. By contrast, this FIG. 5*b* gives a symbolic depiction of the optical device 20, towards which the radiation reflected by the mirror 6 is sent on. In comparison with the embodiment shown in FIGS. 4*a*, 4*b* and 4*c*, it is seen that the elevation structure 2 no longer surrounds the relative bearing structure 3. This enables a small reduction in the dimensions. The port 10 is no longer borne by the relative bearing structure 3.

Besides, when it becomes necessary, owing to the vibrations, to stabilize the line of sight LOS, the aerodynamic force exerted on the port may be a cause of disturbance. In this case, the line-of-sight orientation device is covered with a follower cap 30 uncoupled from the line-of-sight orientation device, as shown in FIGS. 6*a* and 6*b*. The bearings of the cap have axes parallel to the elevation axis OX.

Finally, just as in the structure shown in FIG. 5, where the port was born by the relative bearing structure, in this embodiment, the port 10 is borne by the follower cap 30. Thus, the line-of-sight orientation device is suspended within the follower cap.

In this embodiment, the cap has a shape adapted so that the resistance to air is as low as possible, in all the positions of the unit during its rotation about 0 which, at the same time as it achieves the orientation in elevation, produces a retraction of the device.

Other improvements are possible without going beyond the scope of the invention, for example to set up a dual-axis follower cap, with a part of the cap performing a following operation along the relative bearing axis.

Finally, in the above-described embodiments, the retraction of the device is obtained in the vertical direction, by rotation about a elevation axis off-centered with respect to the input pupil. This device is not restrictive, and it is possible to provide for a lateral retraction of a sighting device provided on the side of the aircraft.

The invention can be applied to all sighting devices, to clear the pilot's visibility while retaining the possibility of sighting along bottom negative sighting angles and to improve the aerodynamism of the system by reducing the protrusion of the sighting device out of the aircraft skin to the minimum. It also has other advantages: in particular, it enables the port of the sighting device to be protected, notably from pluvial erosion and from shocks. This is important because, to circumvent these problems, the ports have to be made of a very hard material, notably sapphire. This can now be avoided.

Finally, another advantage may lie in the reduction of the radar equivalent surface as compared with standard devices which would enable the same angles of deflection to be obtained.

What is claimed is:

1. A self-retractable sighting device for an onboard optoelectronic localizing and identification system including, for the orientation of the line of sight, an elevation structure and a relative bearing structure borne by the elevation structure to which is it is connected by bearings, these two structures being capable of rotating respectively about an elevation axis and a relative bearing axis, wherein the device has an input pupil off-centered with respect to the elevation axis of the device, itself located at a position lower than that of the fuselage of the carrier, the device having an elongated shape with its large dimension close to the vertical with respect to the carrier for the bottom-most line of sight where the elevation angle is negative with respect to the horizontal fuselage reference, and with its large dimension closé to the horizontal with respect to the carrier for the topmost line of sight, the sighting device being in a state of maximum protrusion for the bottom line of sight and then self-retracting as and when the elevation angle increases by rotation about the elevation axis.

2. A device according to claim 1 wherein, beyond the topmost line of sight, the device is capable, by additional rotation about the elevation axis, of occupying a position of maximum retraction where the input pupil is retracted beneath the fuselage of the carrier and where the protrusion of the device out of the fuselage is the minimum.

3. A sighting device according to claim 2, wherein the bottom part of the device in the bottom line of sight position, which is also the top part of the device in the maximum retraction position, is a portion of a sphere.

4. A device according to claim 2, wherein the top part of the device in the bottom line of sight position is formed by a portion of a sphere and a port forming the input pupil of the device.

5. A device according to claims 3 and 4 in combination, wherein the elongated shape of the device is obtained by a cylindrical part connecting the two sphere portions.

6. A device according to claim 1 wherein, with the sighting device including a relative bearing structure within the elevation structure, the input port is borne by the elevation structure.

7. A device according to claim 1 wherein, with the sighting device including a relative bearing structure forming the top part of the device in the bottom line of sight position and an elevation structure forming the bottom part of the device in this same position, the input port is borne by the relative bearing structure.

8. A device according to claim 1 wherein, in addition to the elevation and relative bearing structures, the device includes a follower cap within which the elevation and relative bearing structures are suspended, the elongated shape of the device being given to the follower cap, and the input port being borne by the follower cap.

* * * * *